United States Patent [19]

Hartel

[11] 4,105,001

[45] Aug. 8, 1978

[54] CONTROL MECHANISM FOR OPERATION OF AN INTERNAL COMBUSTION ENGINE

[75] Inventor: Günter Hartel, Neuss-Rosellen, Germany

[73] Assignee: Pierburg GmbH & Co KG, Neuss, Germany

[21] Appl. No.: 736,934

[22] Filed: Oct. 29, 1976

[30] Foreign Application Priority Data

Nov. 3, 1975 [DE] Fed. Rep. of Germany ..... 2548985

[51] Int. Cl.[2] ..... F02D 1/06; F01N 3/00

[52] U.S. Cl. ..... 123/140 CC; 123/140 MC; 123/119 A; 60/285; 60/276

[58] Field of Search ..... 123/140 CC, 140 MC, 123/119 A; 60/276, 285

[56] References Cited

U.S. PATENT DOCUMENTS

| | | | |
|---|---|---|---|
| 2,396,618 | 3/1946 | Stieglitz et al. | 123/140 MC |
| 2,670,724 | 3/1954 | Reggio | 123/140 CC |
| 3,015,326 | 1/1962 | Wirsching et al. | 123/140 CC |
| 3,807,372 | 4/1974 | Garcia | 123/140 CC |
| 3,881,456 | 5/1975 | Nohira et al. | 123/119 A |
| 4,007,719 | 2/1977 | Brettschneider et al. | 60/285 |
| 4,020,808 | 5/1977 | Yagi et al. | 123/119 A |

FOREIGN PATENT DOCUMENTS

| | | | |
|---|---|---|---|
| 2,003,927 | 1/1976 | Fed. Rep. of Germany | 123/140 MC |
| 872,902 | 7/1961 | United Kingdom | 123/140 CC |

*Primary Examiner*—Charles J. Myhre
*Assistant Examiner*—Parshoham S. Lall
*Attorney, Agent, or Firm*—Haseltine, Lake & Waters

[57] ABSTRACT

A control mechanism for operation of an internal combustion engine has a throttle, a plurality of cylinders and a three dimensional cam formed with first and second curved surfaces; the first surface is dependent in cam position from a changeable operating parameter and an arbitrary change in position of the throttle. A control unit determines the total fuel consumption both for the operatively warm and the operatively not warm engine; an exhaust gas return valve and a first control valve is provided for the control unit, as well as a firing point controller and a second control valve for the controller. The control unit and the control valves are controlled by at least one of the curved cam surfaces.

6 Claims, 4 Drawing Figures

CONTROL MECHANISM FOR OPERATION OF AN INTERNAL COMBUSTION ENGINE

FIELD OF THE INVENTION

The invention relates to a control device for operating an internal combustion engine having a plurality of cylinders by means of a three-dimensional cam formed with a curved surface, the three dimensional cam being position dependent from a variable operating parameter and an arbitrarily variable throttle position, the object being to obtain a fuel-to-air-ratio suitable for economic fuel consumption and a low noxious emission at an even operation of the engine.

DESCRIPTION OF THE PRIOR ART

Carburetor constructions having provisions for starting and running when warm, which may be connected to devices for adjusting the ignition point, as well as exhaust gas feedback systems are known to fulfill these requirements. From DT-PS 1451990 there is known a device where the fuel is controlled through a curved surface of a three-dimensional cam, which is adjustable in position for the steady- or warm-state of the internal combustion engine; devices of this kind, however, require control systems of their own.

OBJECT OF THE INVENTION

It is an object of the present invention to devise a control arrangement for both a cold- and warm-running internal combustion engine in which the composition of the exhaust gases, the output, efficiency, and fuel consumption of the engine is optimized by such an arrangement, by determining the ignition point of the exhaust gas to be fed back, and the amount of fuel required by the engine under both stationary and non-stationary operating conditions.

SUMMARY OF THE INVENTION

This task is solved, according to the invention, in a control arrangement of the above-described kind, by the three-dimensional cam being formed with at least another, or second curved surface. It is advantageous that a control unit for determining the total fuel consumption for both the operatively warm and operatively not warm engine, a control valve for an exhaust gas return valve, and a control valve for a firing point controller be disposed on the curved surfaces of the three-dimensional cam. In order also to determine the basic fuel required by the engine, an additional control unit connected to a constant pressure regulator is provided for separate fuel allocation of the warm-running engine via an additional curved surface.

The control unit serving for the fuel consumption is implemented by a regulatory nozzle area being disposed in the fuel feed line and controlled by the three-dimensional cam, by a magnetically controlled regulatory nozzle area for enrichment of the starting mixture, and by a regulatory nozzle area for fuel-enrichment for the purpose of acceleration controlled through the part-vacuum of a suction tube, the latter two nozzle areas being disposed in parallel with the fuel feed nozzle area, and by the entire fuel being fed to a pre-atomizer by means of a pressure regulator controlled in a temperature-dependent manner.

In a further development of the control unit in dependence of the three-dimensional cam there is provided a second regulatory nozzle area formed in the fuel feed line and controlled by the three-dimensional cam, another regulatory nozzle area for enrichment of the fuel mixture also controlled by the three-dimensional cam, a magnetically controlled nozzle area for enrichment of the starting fuel mixture, and a regulatory nozzle area controlled through the part-vacuum of the suction tube for fuel enrichment for acceleration purposes, the fuel enrichment nozzle areas being formed in parallel with the second regulatory nozzle area, a pressure regulator for supplying fuel to the fuel-enrichment nozzle areas controlled in a temperature-dependent manner, a pre-atomizer and a constant pressure regulator for supplying the amount of fuel allotted by the regulatory nozzle area to the pre-atomizer through the second pressure regulator.

A control valve serves for changing the inlet pressure supplied by an air pump into a control pressure, the control valve being constructed to include a plunger abutting a membrane via a compression spring, the plunger being disposed in a chamber accessible to external air, that chamber communicating with a control-pressure chamber via a valve opening, the valve opening being closable by a valve-closure body loaded by a spring, the control pressure chamber communicating with the inlet pressure chamber via an opening closable by the valve closure body.

To prevent pressure fluctuation in the suction tube downstream of the throttle, the exhaust return valve is constructed so that an opening formed in the inlet chamber for the exhaust gas of a constant pressure regulator is controlled by means of a first closure body, which is attached to a first membrane, the first membrane being acted upon on one side thereof by the control pressure, and on the other side thereof by a second compression spring and the atmosphere, an opening of the suction tube being controlled by means of a second closure body which is attached to a second membrane, the second membrane being acted upon on one side by the controlled exhaust pressure, and on the other side by a third compression spring and by the atmosphere.

If other exhaust gas increments are desired within the region of the full load, then the exhaust gas return valve is formed by an opening leading to the exhaust pressure inlet chamber of a constant pressure regulator being controlled by means of a closure body, the latter being attached to a first membrane acted upon on one side by the controlled pressure, and on the other side by a compression spring and the atmosphere, and by an opening leading to the suction tube being controlled by means of another closure body, the other closure body being attached to a second membrane acted upon on one side thereof by the exhaust gas pressure, and a compression spring, and on the other side thereof by the atmosphere.

In the case of special requirements it is advantageous to enlarge the control device to a regulating device, by the pressure difference in the control nozzle area being regulated by means of a pressure change through addition of suction from the suction tube to the pressure controller.

BRIEF DESCRIPTION OF THE DRAWING

Implementation examples of the invention are schematically shown in the drawing and will be illustrated in further detail below, wherein.

DESCRIPTION OF THE PREFERRED EMBODIMENTS

Figure 1:
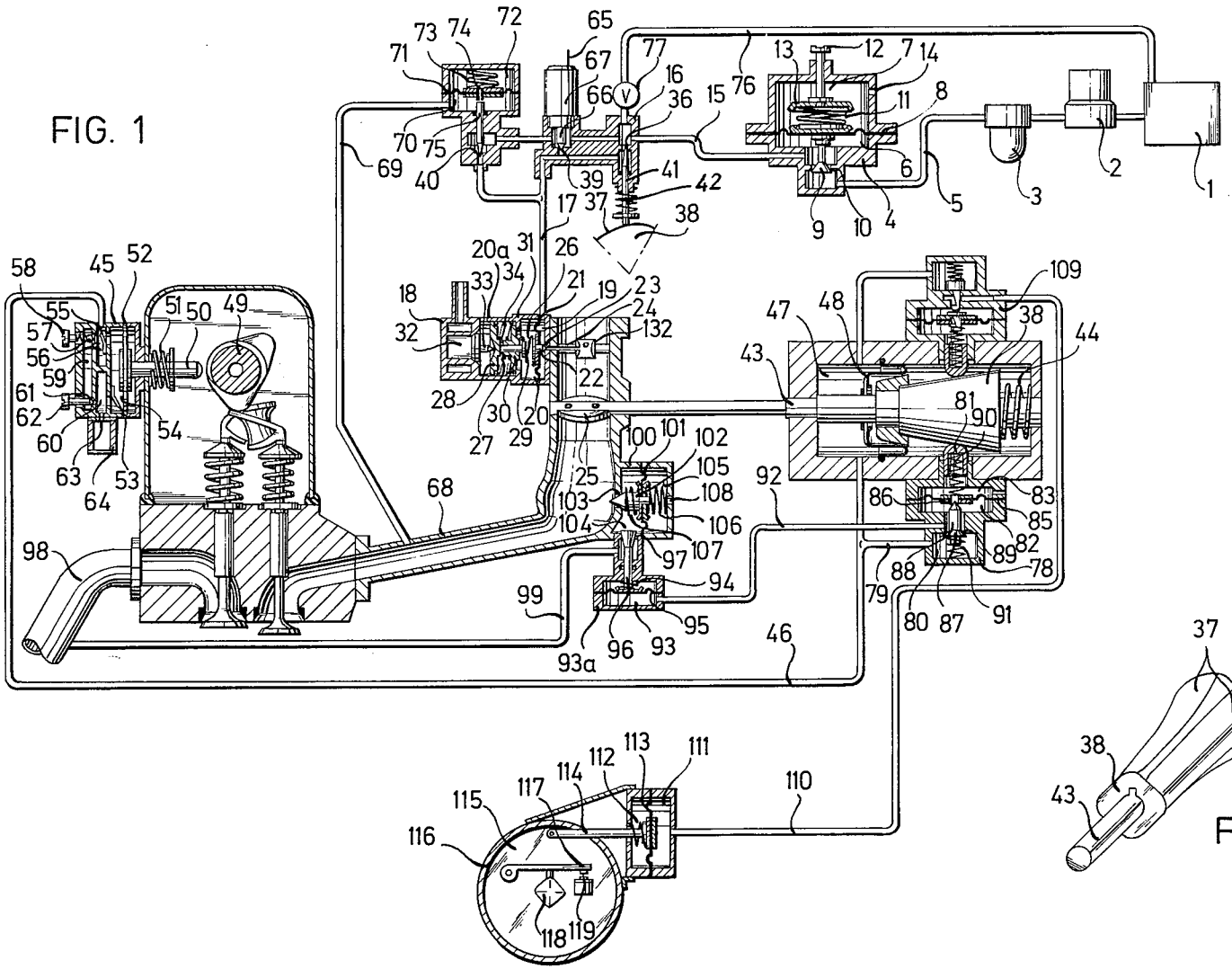
FIG. 1 shows a control device having a control unit for the common supply of basic- and additional-fuel.

The fuel is supplied to a pre-pressure regulator 4 from a container 1 via a fuel pump 2 and a fuel filter 3 through a conduit 5 under pressure.

A pre-pressure regulator 4 is formed with chambers 6 and 7, which are separated by a membrane 8. The membrane 8 is rigidly connected to a valve closure body 9, by means of which a supply area 10 can be changed. A compression spring 11 is disposed in the chamber 7, the force of which may be changed via a set screw 12 and a disc 13 abutting the compression spring; the chamber 7 on one side of the membrane 8 communicates with the atmosphere through a bore 14. The fuel pressure in the chamber 6 is adjustable in dependence of the force of the compression spring 11. Upon the membrane 8 having reached an equilibrium position between the fuel pressure in the chamber 6, and the force of the compression spring 11, the valve closure body 9 is in a regulatory position, the opening area 10 being thereby tailored to the respective fuel throughput, or consumption, so that the pressure in the chamber 6 remains approximately constant.

The fuel is fed from the pre-pressure regulator 4 via a conduit 15 to a control unit 16, and therefrom via a conduit 17 to a pressure regulator 18 controlled in dependence of temperature.

The pressure regulator 18 is formed with chambers 19 and 20 separated from one another by a membrane 21. The membrane 21 is connected rigidly to a valve closure body 22, for an outlet opening area 23 to be made variable. An outlet opening 24 may be disposed ahead, or following the throttle 25. The membrane 21 is loaded from the side of the membrane chamber 20 by means of a compression spring 26, the compression spring 26 abutting on its other side against a disc 30, the disc 30 being displaceable with respect to a spring 27 and disposed on a pin 29 rigidly connected to a spring-supporting disc 28. The movement of the disc 30 is limited by a projection 31 of the housing. The force of the spring 26 is changed by means of an element 32 of extensible material, by means of a pin 33 whose position is dependent on the temperature, and by means of the spring support disc 28. A fuel pressure dependent on temperature and corresponding to the changeable force of the spring 26 is exerted within the chamber 19. The compression spring 34 assures an adequate return force of the pin 33 within the extensible element 32. The extensible element 32 is heated by the cooling water of the engine through a conduit 35, best seen in FIG. 2, or through non-illustrated heating elements. Depending on the level of fuel pressure in the pressure regulator 18, in comparison to the pressure of the pre-pressure regulator 4, there occurs a pressure difference across the control nozzle area 36 in dependence of the temperature of the extensible element 32. Since the pin 33 of the extensible element 32 moves against the force of the compression springs 26 and 34 upon warming up of the engine, an increasing fuel pressure is exerted within the chamber 19 with increasing warming up of the engine, so that the greatest pressure difference occurs in the case of the cold engine, which pressure difference gets to be increasingly smaller upon warming up of the engine, until the spring support disc 30 abuts on the projection of the housing 31. The control unit 16 includes three regulatory nozzle areas 36, 39 and 40 controlled in parallel, and best seen in FIG. 2. The control nozzle area 36, which measures, or determines the amount of fuel for the warm-operating engine, is changed by the position of a jet needle 41. The jet needle is maintained in abutting relationship with the contour of a three-dimensional cam via a compression spring 42. That contour takes the form of a curved surface 37, which is advantageously formed in correspondence with the fuel consumption requirements of the warm-operating engine.

The three-dimensional cam 38 is turnable through a coupling 43 by the throttle 25, and is displaced in an axial direction against the force of a spring 44 in dependence of the number of revolutions of the engine. This is achieved by compressing air of a different pressure via a conduit 46 into a chamber 47 by means of a membrane pump 45 driven by the engine. There results a displacement force on a rolling membrane 48 directed against the compression spring 44, and corresponding to the amount of pressure, so that the three-dimensional cam assumes a different position in an axial direction depending on the amount of pressure.

The different pressure is achieved by the membrane pump 45 being driven directly by the engine, for example by a cam shaft 49 via a plunger 50. The plunger 50 is abutted by a compression spring 51, causing a membrane 52 to perform stroking movements during the suction stroke. Air is thereby passed by an inlet valve 53 into a chamber 54, and therefrom the air passes via an outlet valve 55 into a pressure chamber 56 during the compression stroke. The compression chamber 56 is closed off by a spring-loaded return valve 57, the air passing from the latter into an intermediate chamber 59, starting from a minimal pressure adjustable by a screw 58. The chamber 9 communicates with a chamber 60 through a throttle location 61; the throttle may be made variable by means of a set screw 62. The air arriving from the pressure side is again returned to the inlet side of the membrane pump 45 via the throttle location 61, so that the circulation of the pump is self-adjustable. The chamber 60 communicates via an opening 63 and a filter 64 with the atmosphere. The pressure resulting in the chamber 56 is dependent on the number of strokes per unit time for a predetermined adjustment of the spring-loaded return valve 57, and the throttle location 61. The pressure increases approximately linearly in dependence of an increasing number of revolutions of the engine, which also results in a linear displacement of the three-dimensional cam 38 in an axial direction in dependence of the number of revolutions of the engine.

This makes it possible to achieve any desired value of the fuel-to-air ratio for the engine performance characteristics by appropriate formation of the contour of the three-dimensional cam 38 in dependence of the number of revolutions of the engine, the throttle position, and the temperature of the extensible element 32.

The throttle area 39 serves for an additional fuel enrichment during the starting process when the engine is started from cold. Upon actuation of the starter the closure body 66 of the valve 67 is retracted via the electrical connection 65, and the throttle area 39 is opened. Depending on the temperature of the extensible element 32, a correspondingly suitable amount of fuel per unit time also passes through the control nozzle area 39 in view of the differing pressure difference. The voltage is removed upon conclusion of the starting process, and the control nozzle area 39 is closed. The dimensions of the control nozzle area 39 must be therefore tailored to the requirements of the cold engine during the starting process.

In addition to the requirement of an additional fuel enrichment during the starting process, and the warm running of the engine, an enrichment of this type is also required during non-steady operating conditions, particularly in the case of a cold engine. This is achieved by means of the control unit 16 via the control nozzle area 40 upon an increase in pressure in the suction tube 68. The pressure from the suction tube 68 is transmitted via a conduit 69 to a chamber 70. The chamber 70 is divided by a membrane 71 from the chamber 72, a compression spring 73 being disposed in the latter. The membrane chambers 70 and 72 communicate via a throttle location 74, so that only delayed pressure equalization is possible. A nozzle needle 75 is rigidly connected to the membrane 71. Upon opening of the throttle 75 the pressure in the suction tube 68 and in the chamber 70 increases, so that the membrane 71 is moved against the force of the compression spring 73. This results in a different opening of the control nozzle area 40 depending on the increase of pressure, and consequently results in a different amount of added fuel per unit time, depending on the pressure difference. The time-dependent supply of the additional fuel is hence dependent on the pressure increase in the suction tube 68, on the dimensioning of the throttle location 74, and the characteristics of the compression spring 73. This amount of fuel depends additionally on the temperature of the extensible element 32 determining the pressure difference of the control nozzle area 40, as well as on the selected contour of the nozzle needle 75.

For separation of the vapor bubble a return conduit 76 having a throttle location 77 may be provided on the inlet side of the nozzle areas 36, 39 and 40.

In addition to picking up the amount of fuel on another portion of the periphery of the three-dimensional cam, there is also provided a pickup for the control of the amount of the exhaust gas to be returned. FIG. 1 shows a control valve 78 which permits a transformation of the contour of the three-dimensional cam 38, i.e. the curved surface 37, into a control pressure. An appropriate control pressure is obtained in a chamber 82 in the dependence of a plunger 81, starting from an adequate pressure supply from the membrane pump 45 via the conduits 46 and 79, and the inlet pressure chamber 80. Upon an increasing pressure exerted by the plunger 81, a compression spring 84 disposed in the chamber 83, which chamber is accessible to external air, is also increasingly stressed, and the force exerted on the membrane 85 is increased. This causes closure of the valve area 86, and a cone 87 of the valve closure body 88 is lifted from the seat of the valve area 89, until pressure has built up in the chamber 82, the pressure being in equilibrium with the force of a compression spring 90. It is the task of the compression spring 91 to cause the valve closure body 88 to abut at least one of the valve areas 86 and/or 89. Upon an excursion of the plunger 81 the force of the compression spring 90 is reduced, so that the pressure prevailing in the chamber 82 causes the membrane 85 to yield, so that the valve area 86 remains open until the pressure in the chamber 81 is in equilibrium with the force of the compression spring 90. In this manner, it is possible to obtain arbitrarily controlled pressures in the chamber 82 by means of the contour of the three-dimensional cam 38 in dependence of the throttle position, and the number of revolutions of the engine. The valve closure body 88 is manufactured from a technical implementation point of view (see control valve 109), so that it consists of two parts, which are always urged to one another by spring forces to permit a displacement of the membrane 85 without any friction forces arising during its guidance. The control pressure is transmitted via a conduit 92 into a chamber 93, and onto a membrane 95 of a return valve 93, the membrane 95 being loaded by a compression spring 94.

The amplification in the position or displacement force can be selected by the ratio of the membrane surfaces 85 and 95.

Different positions of the membrane 95 and the valve closure body 96 rigidily connected therewith result in dependence of the level of pressure. It is possible with the aid of the contour of the closure body 96 to associate a predetermined opening area for each control pressure. Exhaust gas flows from an exhaust conduit 98 via a conduit 99 to an opening area 97. Upon inlet of the exhaust gas into the suction tube 68 following the throttle 25 it is, as a rule, advantageous to interpose still another constant pressure regulating valve 100.

This constant pressure regulation valve 100 includes a membrane 101 with a closure body 102 rigidly connected thereto, an opening 103 leading to the suction tube 68, chambers 104 and 105, as well as compression springs 106 or 107; the chamber 105 communicates with the atmosphere via a bore 108. Against the action of the compression spring 107 a suction pressure, or partial vacuum, is created in the chamber 104. Upon use of the compression spring 106, however, a constant overpressure occurs over the whole operating region of the engine. Depending on the requirements of the exhaust-gas return-increments within the region of the full load (high suction tube pressures), one of the two arrangements can be selected.

By means of the constant pressure regulating valve 100 it is possible to reduce the high pressure differences from the exhaust conduit 98 to the suction tube 68 occurring across the closure body 96.

The second control valve 109 serves for control of the firing point in dependence of the throttle position and the number of revolutions of the engine. The contour of the three-dimensional cam 38 is also sensed by a further curved surface 37 on another portion of its periphery, and transformed into control pressure, so that arbitrary firing points may be obtained for each operating point, depending on the level of the control pressure. The control pressure is transmitted by a conduit 110 into a chamber 111, and displaces there a membrane 113 against the force of a compression spring 112. A base plate 115 of a distributor 116 is displaced by means of the membrane 113 through the operating rod 114. A contact breaker 117 is lifted sooner or later by the cams 118 from the contacts 119 through the turning of the base plate 115, and the firing process is started.

Figure 2:
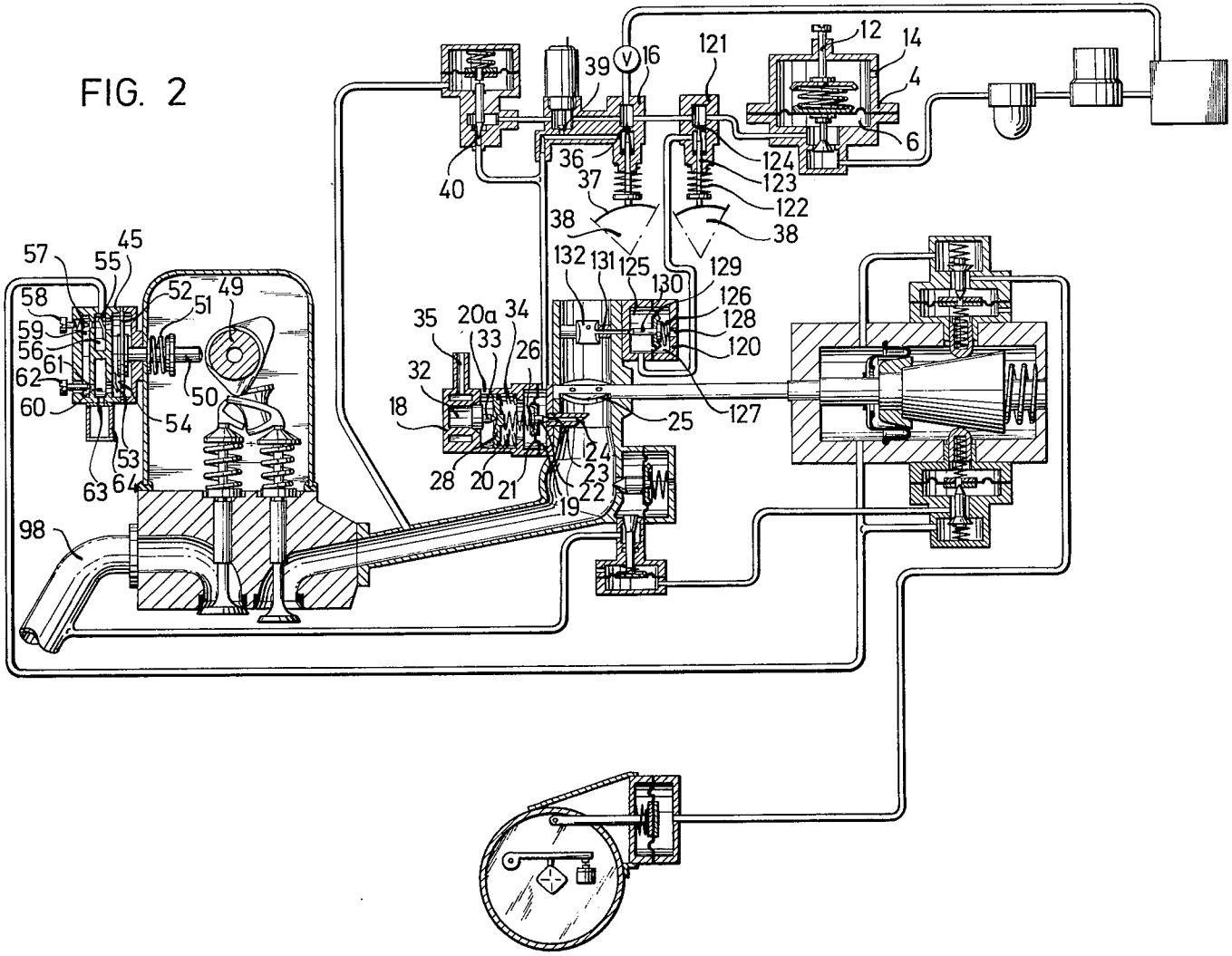
FIG. 2 shows a control arrangement having an additional control device for the supply of basic fuel.

FIG. 2 shows a device in which the fuel is supplied by means of a constant pressure regulator 120, and a control nozzle unit 121. Parallel to the nozzle control areas 36, 39 and 40, which have already been shown in FIG. 1, and by means of which the additional amount of fuel of the engine not operating in a warm state is controlled, the basic amount of fuel for the engine operating in a warm state is supplied in the present arrangement to the control nozzle area 124 via a needle 123 by means of a further contour disposed on the periphery of the three-dimensional cam 38 via the needle 123, the latter abutting the contour by means of a compression spring 122. The pressure difference prevailing on the control nozzle area 124 results from the difference of the pressures in the membrane chamber 6 of the pre-pressure regulator 4, and in the membrane chamber 125 of the pressure regulator 120. The degree of pressure in the membrane chamber 125 is determined by the force of a compression spring 126 in a membrane chamber 127; the membrane chamber 127 communicates with the atmosphere through a bore 128. The membrane chambers 125 and 127 are separated by a membrane 129, and a valve closure body 130 is rigidly connected to the membrane 129. The fuel admitted is fed via an outlet bore 131 into a pre-atomizer 132, and is there admixed to the air sucked in. The pressure difference originally set by the regulating screw 12 on the control nozzle area 124 is constant within the whole operating region of the engine. This device therefore makes possible a pointwise matching of the fuel for the engine operating in a warm state by means of the contour of the three-dimensional cam 38 in dependence of the throttle, and the number of revolutions of the engine.

The temperature-dependent pressure regulator 18 can be implemented in a simplified fashion in the implementation example according to FIG. 2, since the amount of basic fuel is supplied independent of temperature. The pressure regulator 18 is formed with chambers 19 and 20, which are separated by the membrane 21. The membrane 21 is rigidly connected to the valve closure body 22, the outlet opening 23 being changeable thereby. The membrane 20 is loaded or stressed by means of the compression spring 26 from the membrane chamber 20, the force of the compression spring 26 being changed by means of the extensible element 32 and the pin 33, which is temperature dependent in its position, and the spring support disc 28. A fuel pressure dependent on temperature corresponding to the variable force of the spring 26 is obtained in the chamber 19. The compression spring 34 ensures an adequate return positioning force of the pin 33 in the extensible element. The extensible element 32 is heated by the engine cooling water via the connection 35. A pressure difference prevails in the control unit 16 in dependence of the temperature in the extensible element 32, which in turn is dependent on the level of the fluid pressure in the pressure regulator 18 compared to the pressure of the pre-pressure regulator 4, but which is independent of the operating point of the engine characteristics, i.e. independent of the sensing contact of the curved surface 37 of the three-dimensional cam 38. Since the pin 33 of the extensible element 32 moves against the force of the compression springs 26 and 34 upon warming up of the engine, an increasing fluid pressure is obtained in the chamber 29 upon an increased warming up of the engine; thus the highest pressure difference exists for the cold engine, which progressively decreases upon warming up of the engine, and finally reaches the value of zero for the engine in an operatively warm state.

Figure 4:
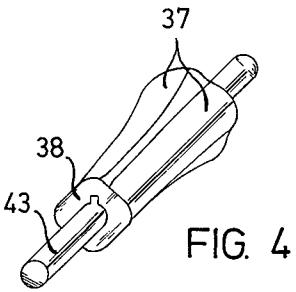
FIG. 4 shows a three-dimensional cam and the contours of the curved control surfaces.

FIG. 4 shows a three-dimensional cam 38 and the contours of the curved surface 37. Up to four of the latter can be distributed on its surface, so that transition regions exist between these surfaces.

The control arrangement will now be discussed further; it may be desirable for different reasons to superimpose a control magnitude in the engine characteristics on the dependence of the amount of fuel from the angle of the throttle, and the number of revolutions of the engine, or the air throughput, in order to obtain certain predetermined effects. It is, for example, necessary for the operation of a three-way catalyst to ensure an extremely narrow matching of the fuel-to-air ratio to the pre-determined value of lambda = 1.00. An oxygen probe 133 (FIG. 3) disposed in the exhaust gas conduit 98 serves as a rule for the measurement thereof, the probe feeding its signals to an electronic amplifier 134, which in turn controls the electromagnetic control valve 135. Depending whether a "1" or a "0" signal is present, the latter connects either the control pressure conduits 136 and 137, or the conduits 137 and 138. Upon connecting control pressure conduit 136 to 137 the membrane 20 is made to communicate with the atmosphere. If, however, the control pressure conduits 138 and 137 are connected together, an indirect communication with the suction tube exists which makes it possible to reduce the pressure in the chamber 20 to a certain extent; upon reduction of pressure in the chamber 20, the pressure in the chamber 19 is reduced by the same amount due to the equilibrium conditions on the membrane 21, which causes the pressure difference across the control nozzle areas 36, 39 and 40 to increase, so that the fuel/air ratio is enriched.

The effective or operating connection to the suction tube pressure is obtained via a constant pressure regulator 139. The control pressure conduit 138 communicates with the chamber 140 of the constant pressure regulator 139. The connection of the suction tube 141, also communicating with the chamber 141, is closable by a valve closure body 142, which is rigidly connected to the membrane 143, so that the suction pressure in the chamber 140 can only operate up to a predetermined level. The level of this suction pressure, or partial vacuum, is determined by the force of the compression spring 144. The chamber 145 communicates via a bore 146 with the atmosphere. The force of the compression spring 144 can be advantageously adjusted so that the following result is obtained whereby the mixture ratio can be enriched only by a certain maximal percentage upon connection of the control pressure conduits 138 and 137. Due to the fact that the pressure difference prevailing across the control nozzle areas 36, 39 and 40 is constant over the whole operating region without this control action, that pressure difference is also influenced independent of the engine characteristics upon the addition of this regulating system in the proposed manner, so that the control action leads to percentagewise equal changes in the mixture ratio independent of the engine characteristics. In this implementation form the elements between the markings 147 are dispensed with, so that the chamber 7 remains in communication with the atmosphere.

Figure 3:
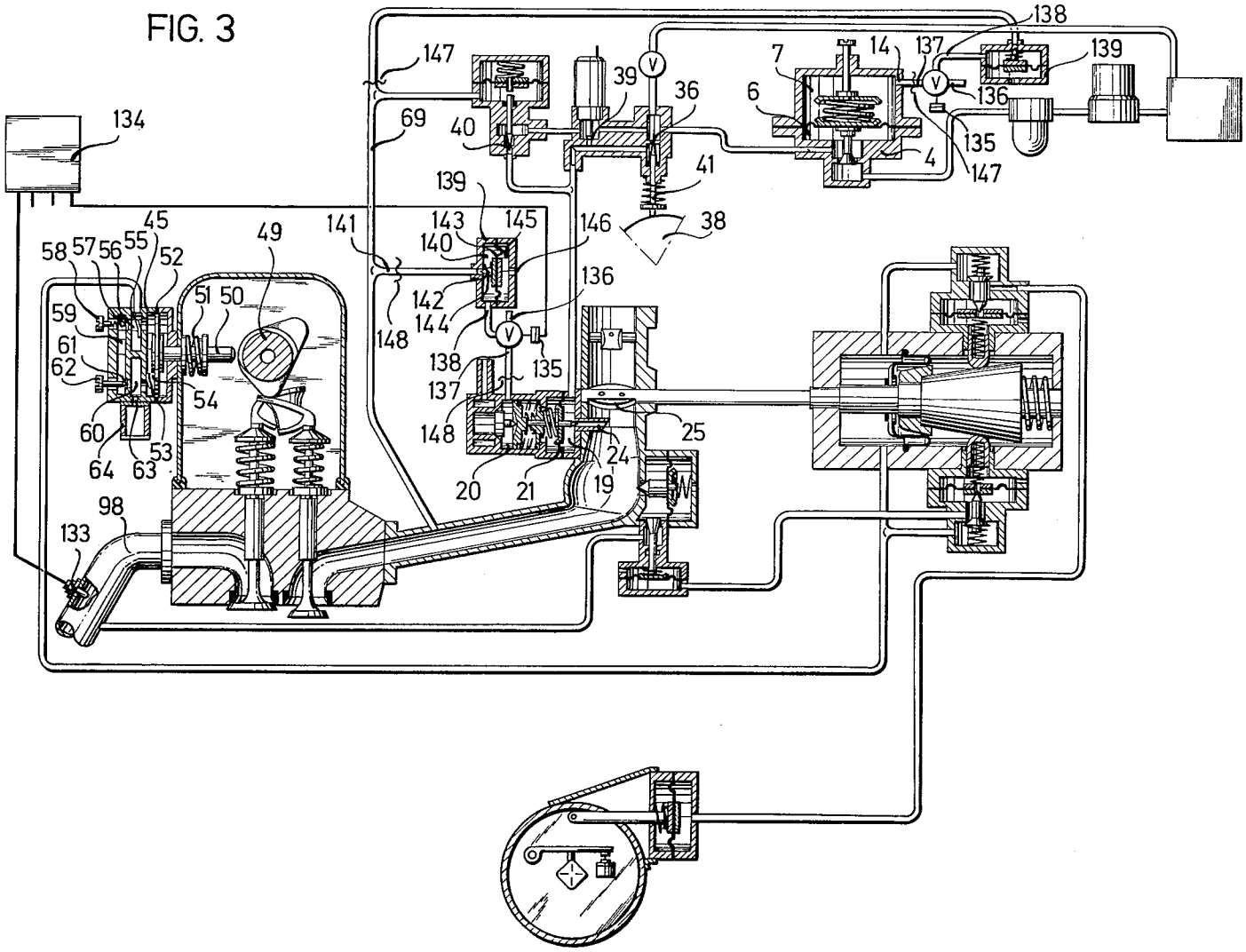
FIG. 3 shows a regulating device based on the control device of FIG. 1.

In the case where the basic matching of the amount of fuel to the number of revolutions of the engine and the throttle opening, or to the air input is not to be changed by the control action in a direction of fuel enrichment, but in the opposite direction, then the same control action on the pre-pressure regulator 4 and the air opening 14 is possible in principle. The fuel pressure in chamber 6 is reduced by the same amount through decrease of the pressure in the chamber 7. This causes the pressure difference across the control nozzle areas 36, 39 and 40 to be reduced by the control action, and the mixture ratio is changed in the direction of fuel deprivation. Which of the control actions is selected depends on the respective tasks to be solved. Also, and in dependence of the respective tasks, and the type of sensor signals, either the total fuel amount, or the fuel amount for the warmed up engine, as illustrated in FIG. 3, (i.e. possible action on the bore 128 of the constant pressure regulator 120 of FIG. 2), of merely the additional fuel amount (i.e. possible action on the bore 20a of the pressure regulator 18 in FIG. 2) is included in the regulation system for the engine which has not operatively warmed up. In this implementation form the elements between the markings 148 are dispensed with — (see FIG. 3) — so that the chamber 20 still communicates with the atmosphere.

What I claim is:

1. A control mechanism for operation of an internal combustion engine having a throttle, a plurality of cylinders and a three-dimensional cam (38) formed with first and second curved surfaces (37), the first surface being dependent in cam position from a changeable operating parameter and an arbitrary change in position of the throttle, comprising a control unit (16) for determining the total fuel consumption both for the operatively warm and the operatively cold engine, an exhaust gas return valve **(93*a*) and a first control valve (78) for controlling said exhaust gas return, and a firing point controller (116) and a second control valve (109) for controlling said firing point controller, said control unit (16) and said control valves (78, 109) being controlled by at least one of said curved surfaces (37), said engine including a fuel feed line (15) and a suction tube, and further comprising a first regulatory nozzle area (36) formed in said fuel feed line (15) and controlled by said three-dimensional cam (38), a magnetically controlled regulatory nozzle are (39) for enrichment of the engine's starting fuel mixture, a regulatory nozzle are (40) for fuel enrichment for the purpose of accelerating the engine and controlled through the part-vacuum in said suction tube, the latter two nozzle areas (39, 40) being formed in said fuel feed line (15) in parallel with the first nozzle area (36), a pressure regulator (18) controlled dependent on temperature of cooling water and a pre-atomizer (132) fed by said pressure regulator (18), the entire fuel being fed to said pre-atomizer (132)**.

2. A control mechanism according to claim 1 wherein said cam (38) is formed with a third curved surface (37) and further comprising a constant pressure regulator (120) and a second control unit (121) connected to said constant pressure regulator (120) for separate fuel allocation to the operatively warm and the operatively cold engine, said second control unit (121) being controlled by said third curved surface (37).

3. A control mechanism according to claim 1 wherein said engine includes a fuel feed line (15) and a suction tube and further comprising a second regulatory nozzle area (124) formed in said fuel feed line and controlled by said three-dimensional cam (38), a regulatory nozzle area (36) for enrichment of the fuel mixture also controlled by said three-dimensional cam, a magnetically controlled nozzle area (39) for enrichment of the starting fuel mixture, and a regulatory nozzle area (40) controlled through the part-vacuum of the suction tube for fuel enrichment for acceleration purposes, the fuel enrichment nozzle areas (36, 39, 40) being formed in parallel with said second regulatory nozzle area (124), a second pressure regulator (120) for supplying fuel to said fuel-enrichment nozzle areas (36, 39, 40) controlled in a temperature-dependent manner, a pre-atomizer (132) and a constant pressure regulator (120) for supplying the amount of fuel allotted by said second regulatory nozzle area (124) to said pre-atomizer (132) through said pressure regulator (120).

4. A control mechanism according to claim 1 further comprising an air pump for supplying an inlet pressure, said first control valve (78) changing the inlet pressure supplied by said air pump into a control pressure, said first control valve (78) including a plunger (81), a first membrane (85) and a first compression spring (90), said plunger (81) abutting said membrane (85) via said compression spring (90), a chamber accessible to external air (83), said plunger (81) being disposed in the external-air accessible chamber, said first valve (78) being formed with an opening (86), a control-pressure chamber (82) communicating with said external-air accessible chamber through the valve opening (86), a spring (91), a valve closure body (88) for closing said valve opening (86) by meansof said spring (91), an inlet pressure chamber (80) communicating with said control-pressure chamber (82) through an opening (89) formed therebetween, the latter opening (89) being closable by said valve closure body (88).

5. A control mechanism according to claim 1 wherein said exhaust return valve (93a) includes a constant pressure regulator (100) for the exhaust gas, said constant pressure regulator (100) having an inlet chamber (104) for the exhaust gas, the latter chamber (104) being formed with an opening (97), and further comprising a first closure body (102) for controlling said inlet chamber (104), a second membrane (95) attached to said first closure body (102), said second membrane (95) being acted upon on one side thereof by a control pressure and by the atmosphere on the other side thereof, a second compression spring (94) for also acting on the other side of said second membrane, a suction tube (68) formed with an opening (103), a third membrane (101), a second closure body (102) attached to said third membrane (101) for controlling said opening (103) of said suction tube (68), said third membrane (101) being acted upon on one side thereof by a controlled exhaust pressure, and on the other side thereof by the atmosphere, and at least a third compression spring (106, 107) for also acting on the other side of said third membrane (101).

6. A control mechanism according to claim 1 further comprising an exhaust conduit (98), an electromagnetically regulated valve (135), an oxygen probe (133) disposed in said exhaust conduit, and an amplifier (134) for controlling said electromagnetically regulated valve (135), a first pressure regulator (4, 18), a fuel feed line (15), and a plurality of regulatory nozzle areas (36, 39, 40) formed in said fuel feed line (15), a pressure difference being formed across said regulatory nozzle areas (36, 39, 40), said pressure difference being controllable by means of a pressure change through the part vacuum of a suction tube.

* * * * *